US007976288B2

(12) United States Patent
Inoue et al.

(10) Patent No.: US 7,976,288 B2
(45) Date of Patent: Jul. 12, 2011

(54) REFRIGERANT GAS COMPRESSOR

(75) Inventors: Yoshinori Inoue, Kariya (JP); Naoki Koeda, Kariya (JP); Akinobu Kanai, Kariya (JP); Hiroyuki Nakaima, Kariya (JP); Tomoji Tarutani, Kariya (JP)

(73) Assignee: Kabushiki Kaisha Toyota Jidoshokki, Aichi-Ken (JP)

( * ) Notice: Subject to any disclaimer, the term of this patent is extended or adjusted under 35 U.S.C. 154(b) by 827 days.

(21) Appl. No.: 11/750,466

(22) Filed: May 18, 2007

(65) Prior Publication Data

US 2007/0269319 A1 Nov. 22, 2007

(30) Foreign Application Priority Data

May 19, 2006 (JP) ..... P2006-139734
Dec. 27, 2006 (JP) ..... P2006-352221

(51) Int. Cl.
*F04B 1/12* (2006.01)

(52) U.S. Cl. ..... 417/269

(58) Field of Classification Search ..... 417/228, 417/269

See application file for complete search history.

(56) References Cited

U.S. PATENT DOCUMENTS 3,215,341 A * 11/1965 Francis ..... 417/269
4,886,424 A * 12/1989 Ikeda et al. ..... 417/269
5,580,224 A * 12/1996 Ikeda et al. ..... 417/269
5,636,974 A 6/1997 Ikeda et al.
5,718,566 A 2/1998 Ikeda et al.
6,015,269 A * 1/2000 Ota et al. ..... 417/222.2
6,382,927 B1 * 5/2002 Sonobe et al. ..... 417/269
2005/0249608 A1 * 11/2005 Tagami ..... 417/269
2007/0177988 A1 * 8/2007 Inoue et al. ..... 417/269

FOREIGN PATENT DOCUMENTS

JP 8-270553 A 10/1996
JP 9-209928 A 8/1997
JP 9-287569 A 11/1997
JP 2000-345960 A 12/2000
JP 2001-027177 A 1/2001
JP 2003-293950 A 10/2003
JP 2004-044463 A 2/2004

OTHER PUBLICATIONS

Machine Language Translation of Japanese Patent 2004-044463 to inventor Nonoyama published on Feb. 12, 2004.*
English Summary of JP Office Action mailed on Dec. 28, 2010 for corresponding JP Application No. 2006-352221.

* cited by examiner

*Primary Examiner* — William H Rodriguez
*Assistant Examiner* — Dnyanesh Kasture
(74) *Attorney, Agent, or Firm* — Knoble Yoshida & Dunleavy, LLC

(57) ABSTRACT

A refrigerant gas compressor includes a cylinder block formed with plural cylinder bores, a first housing disposed at the one end of the cylinder block, a second housing disposed at the other end of the cylinder block, a drive shaft supported by the cylinder block and one of the housings, a crank chamber formed in one of the housings, a suction chamber and a discharge chamber formed in one of the housings, a valve plate assembly disposed between the cylinder block and at least one of the housings, a stepped portion formed adjacent to the valve plate assembly to receive a part of the valve plate assembly. A storage chamber is provided for reserving therein oil separated from refrigerant gas. An oil groove is formed by the stepped portion and the valve plate assembly and connecting the storage chamber with one of the crank chamber and the suction chamber.

6 Claims, 11 Drawing Sheets

REFRIGERANT GAS COMPRESSOR

BACKGROUND OF THE INVENTION

The present invention relates generally to a compressor and more specifically to a mechanism in the compressor for separating oil from refrigerant gas and then returning the separated oil to a crank chamber or a suction chamber of the compressor.

Japanese Unexamined Patent Application Publication No. 9-209928 discloses a compressor in which a muffler chamber is formed in the top of a cylinder block in communication with a discharge chamber for separating oil from discharged gas. A communication hole is formed in the bottom of the muffler chamber for communication with a bolt hole in the upper part of the cylinder block. The upper bolt hole communicates with a bolt hole in the lower part of the cylinder block through a narrow throttled passage formed in a gasket. The throttle passage serves as an oil circulating passage. The lower bolt hole communicates with a crank chamber.

The oil separated in the muffler chamber is temporarily reserved in the upper bolt hole. The oil then flows through the throttle passage and the lower bolt hole and into the crank chamber.

The narrow throttled passage for communication between the upper bolt hole and the lower bolt hole requires an additional special machining to form a fine groove through a gasket.

An object of the present invention is to provide a compressor in which an oil return passage is formed without requiring any additional machining.

SUMMARY OF THE INVENTION

In accordance with an aspect of the present invention, a refrigerant gas compressor includes a cylinder block with two ends formed with a plurality of cylinder bores, a front housing disposed at one of the two ends of the cylinder block, a rear housing disposed at the other end of the cylinder block, a drive shaft supported by the cylinder block and one of the front housing and rear housing, a crank chamber formed in one of the front housing and the rear housing, a swash plate rotatably disposed in the crank chamber, the swash plate being driven by the drive shaft, a suction chamber and a discharge chamber formed in one of the front housing and rear housing, a valve plate assembly disposed between the cylinder block and at least one of the front housing and rear housing, a storage chamber that is separate from the crank chamber for storing therein oil separated from refrigerant gas, an oil passage connected to the storage chamber for the oil to flow from the storage chamber, a stepped portion at least partially formed in a gasket that receives part of the valve plate assembly, and an annular oil groove formed by the stepped portion and the valve plate assembly and connected to the oil passage for connecting the storage chamber with one of the crank chamber and the suction chamber, wherein at least a portion of the oil groove is radially offset from the oil passage.

Because the groove is used as an oil return passage having a throttle, any additional process for forming a narrow passage in the valve plate assembly is not required.

Other aspects and advantages of the invention will become apparent from the following description, taking in conjunction with the accompanying drawings, illustrating by way of example the principles of the invention

BRIEF DESCRIPTION OF THE DRAWINGS

The features of the present invention that are believed to be novel are set forth with particularity in the appended claims.

The invention together with objects and advantages thereof, may best be understood by reference to the following description of the presently preferred embodiment together with the accompanying drawings in which.

DETAILED DESCRIPTION OF THE PREFERRED EMBODIMENTS

Figure 1:
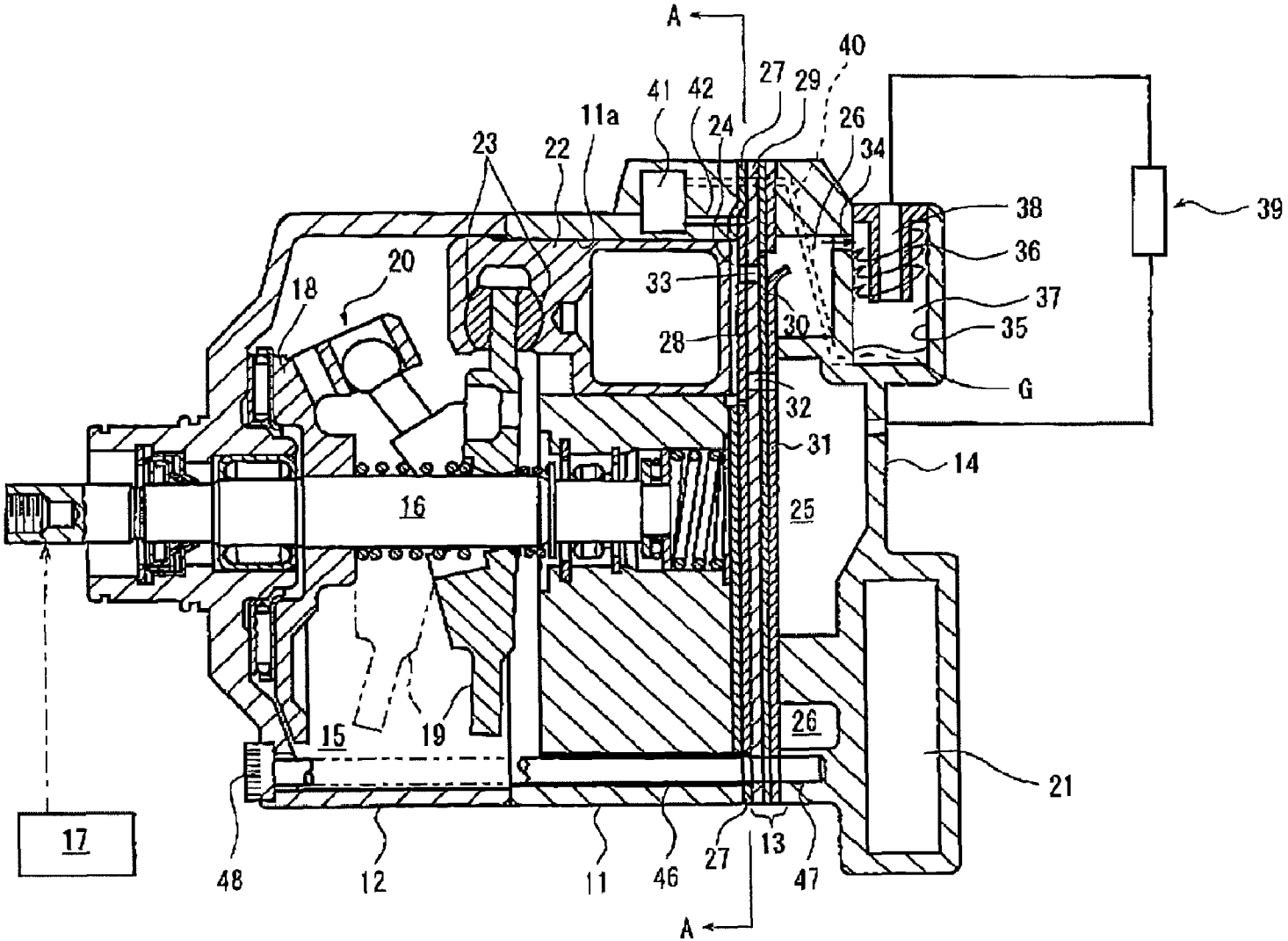
FIG. 1 is a longitudinal sectional view of a swash plate type variable compressor according to a first preferred embodiment of the present invention.

The following will describe a swash plate type variable displacement compressor (hereinafter referred to merely as "compressor") according to a first preferred embodiment of the present invention with reference to FIGS. 1 through 4. FIG. 1 shows a compressor which includes a cylinder block 11, a front housing 12 as a first housing disposed to the front end of the cylinder block 11 and a rear housing 14 as a second housing disposed to the rear end of the cylinder block 11 through a valve plate assembly 13 and a gasket 27 which will be described below. "Housing block" in this embodiment refers to one of or both of the front housing 12 and the rear housing 14. The front housing 12, the cylinder block 11 and the rear housing 14 are fastened together securely by a plurality of bolts 48 (only one bolt being shown in the drawing). Specifically the bolts 48 are inserted from the front wall of the front housing 12 into bolt holes 46 in the cylinder block 11 and screwed into threaded holes 47 formed in the rear housing 14. Positioning pins 49 fixed to the cylinder block 11 (shown in FIG. 2) are inserted in holes (not shown) formed in the rear housing 14 for positioning thereof. The cylinder block 11 and the front housing 12 cooperate to define therebetween a crank chamber 15. A drive shaft 16 is supported by the cylinder block 11 and the front housing 12 and extends through the crank chamber 15. The drive shaft 16 is operatively connected to an engine 17 of a vehicle and is driven thereby to be rotated.

In the crank chamber 15, a lug plate 18 is fixed on the drive shaft 16 for rotation therewith and a swash plate 19 is supported tiltably and also slidably along the axial direction of the drive shaft 16. Hinge mechanism 20 is located between the lug plate 18 and the swash plate 19. Thus, the swash plate 19 is synchronously rotatable with the lug plate 18 and the drive shaft 16 through the hinge mechanism 20 and it is also tiltable while sliding in the longitudinal direction of the drive shaft 16. Inclination angle of the swash plate 19 is adjusted by a displacement control valve 21.

The cylinder block 11 is formed with plural cylinder bores 11*a*, only one of which is shown in FIG. 1, and a single-headed piston 22 is reciprocally slidably received in each of cylinder bores 11*a*. Each piston 22 is engaged with outer peripheral portion of the swash plate 19 through a pair of shoes 23. Thus, the rotational movement of the swash plate 19 driven by the drive shaft 16 is converted into reciprocating movement of the piston 22 by way of the shoes 23. A compression chamber 24 is defined by the piston 22, the gasket 27 and the valve plate assembly 13 in the rear portion of each cylinder bore 11*a* of the compressor or the right side of the cylinder bore 11*a* as seen in FIG. 1.

A suction chamber 25 is formed in a radially inner region of the rear housing 14. A discharge chamber 26 is formed in a radially outer region of the rear housing 14. Between the cylinder block 11 and the rear housing 14, the gasket 27 and the valve plate assembly 13 are arranged in this order as viewed from the side of the compression chamber 24. The valve plate assembly 13 includes a suction valve forming plate 28, a valve plate 29, a discharge valve forming plate 30 and a retainer plate 31 that are arranged in this order from the front of the compressor. The valve plate 29 has formed therethrough a suction port 32 for introducing low-pressure refrigerant gas from the suction chamber 25 into each of the cylinder bores 11*a*. The valve plate 29 has a discharge port 33 for discharging therethrough compressed high-pressure refrigerant gas from each of the cylinder bores 11*a* into the discharge chamber 26. The suction valve forming plate 28 has a suction valve 28*d* for opening and closing the suction port 32 and the discharge valve forming plate 30 has a discharge valve 30*a* for opening and closing the discharge port 33.

Refrigerant gas in the suction chamber 25 is introduced into the compression chamber 24 through the suction port 32 by movement of the each piston 22 from the top dead center to the bottom dead center. Then, the refrigerant gas which is drawn into the compression chamber 24 is compressed to a predetermined pressure by the movement of the each piston 22 from the bottom dead center to the top dead center, and flows into the discharge chamber 26 through the discharge port 33.

A cylindrical hole 35 is formed in the rear housing 14 in the vertical direction at the right side of the discharge chamber 26 of the rear housing 14 in FIG. 1. The upper end of the cylindrical hole 35 is opened. A separation chamber 37 is formed by fitting an oil separator 36 into the cylindrical hole 35 and this separation chamber 37 communicates with the discharge chamber 26 through a discharge passage 34. Refrigerant gas which is introduced into the separation chamber 37 from the discharge passage 34 swirls downwardly in the space between the cylindrical surface of the oil separator 36 and inner wall of the separation chamber 37, so that oil G is centrifuged from the refrigerant gas, and then accumulated in the bottom of the separation chamber 37. The refrigerant gas having the oil G separated therefrom is discharged into an external cooling circuit 39 through a gas passage 38 in the oil separator 36. Due to the pressure differential, the oil G which is accumulated in the bottom of the separation chamber 37 flows into an oil storage chamber 41 at the top of the cylinder block 11 through an oil passage 40 and stored therein.

Figure 2:
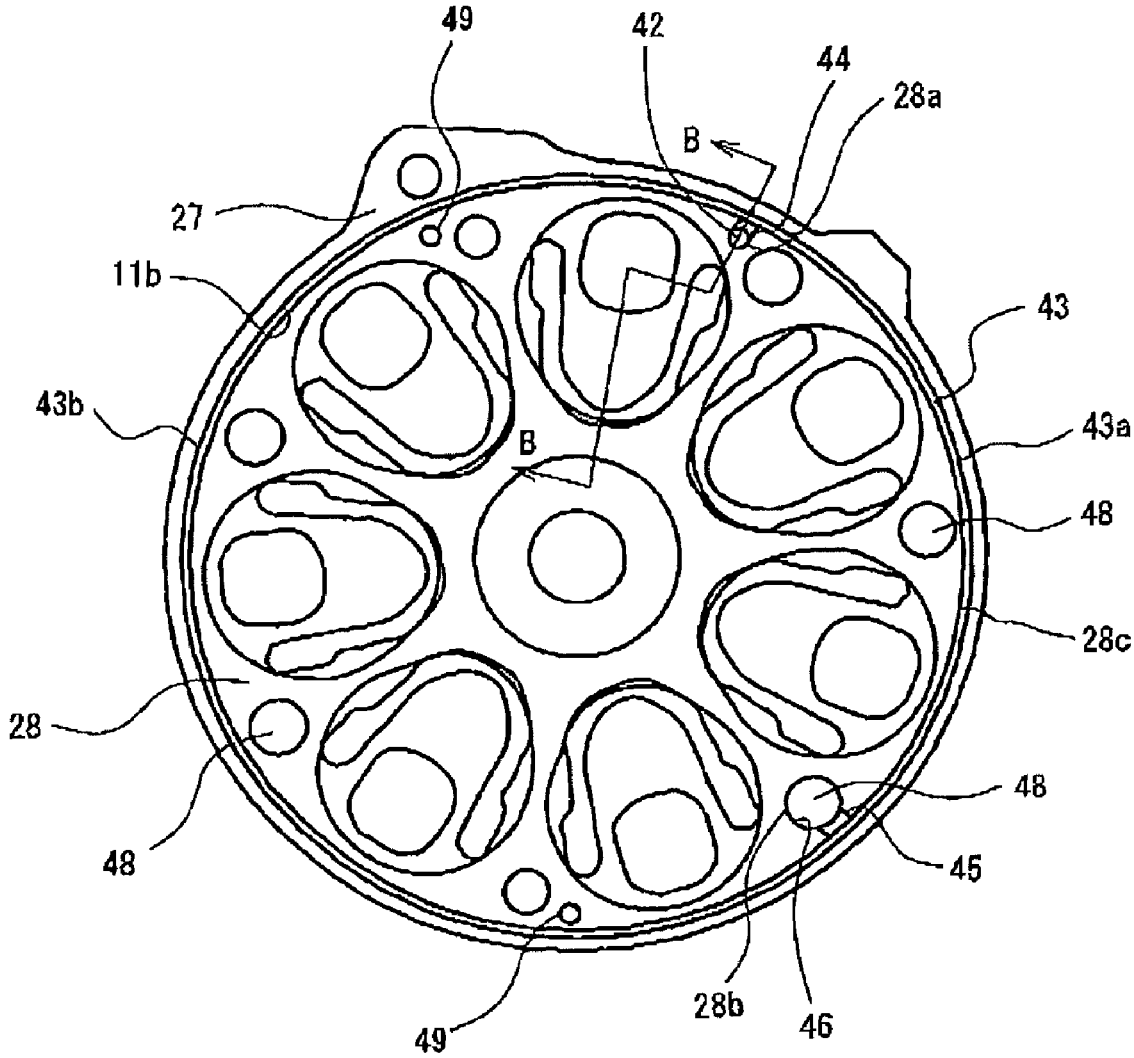
FIG. 2 is a cross-sectional view taken along the line A-A in FIG. 1.
Figure 3:
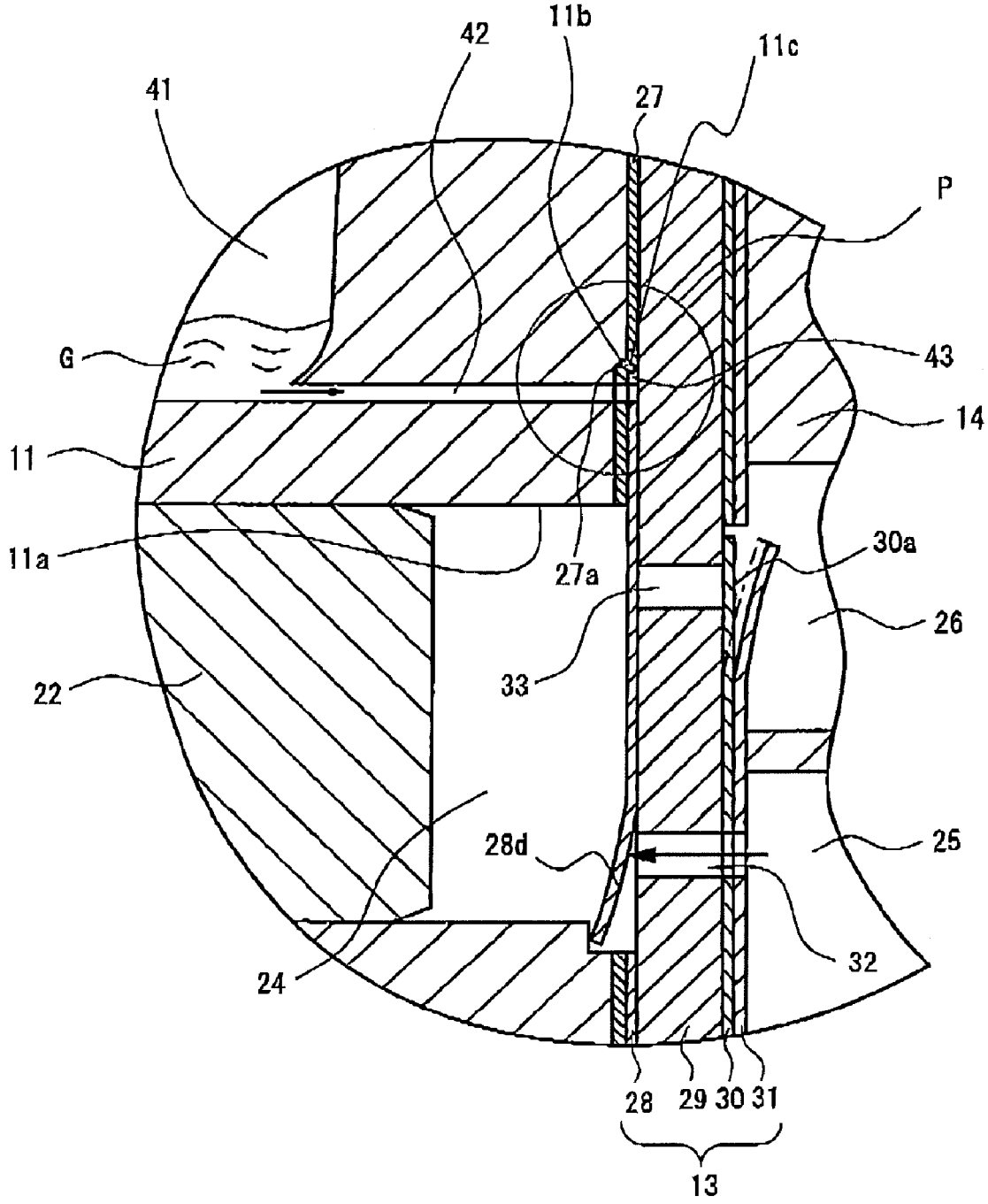
FIG. 3 is a partially enlarged cross-sectional view taken along the line B-B in FIG. 2.
Figure 4:
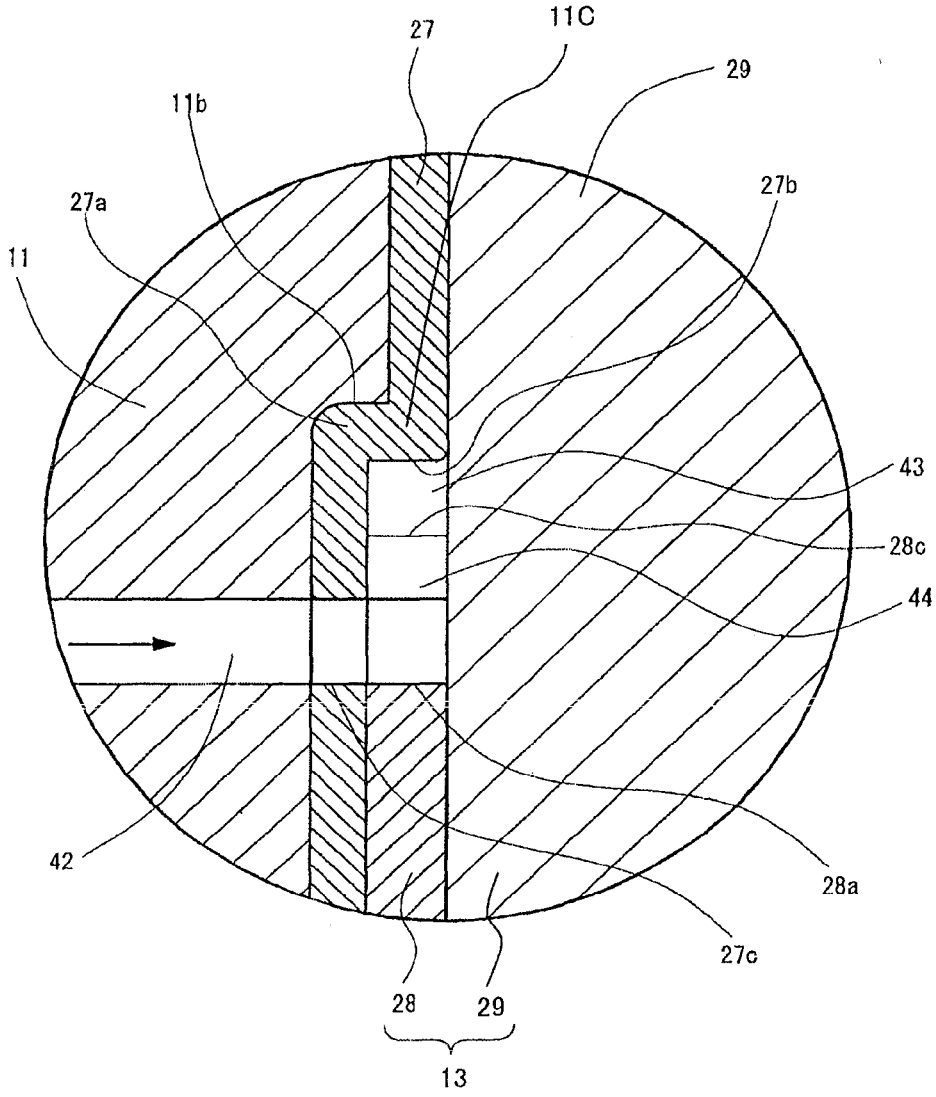
FIG. 4 is an enlarged cross-sectional view showing the encircled portion P in FIG. 3.

As shown in FIG. 2 through FIG. 4, the cylinder block 11 is formed on the rear end face thereof with an annular recess 11*b* which is recessed in the axial direction of the drive shaft 16 for receiving therein part of the gasket 27. That is, the gasket 27 has a bent portion 27*a* which is formed by bending a part of the gasket 27 adjacent to the cylinder block 11 and the bent portion 27*a* of the gasket 27 is disposed in close contact with the recess 11*b* of the cylinder block 11. A step, or a stepped portion 11*c* is provided by the bent portion 27*a* of the gasket 27 and the recess 11*b*. The stepped portion 11*c* is formed adjacent to the valve plate assembly 13 and receives a part of the valve plate assembly 13. The circular suction valve forming plate 28 which constitutes a part of the valve plate assembly 13 is positioned between the bent portion 27*a* of the gasket 27 and the valve plate 29 to be in close contact therewith. The outer diameter of the suction valve forming plate 28 is slightly smaller than the inner diameter of the gasket 27 at the inner peripheral surface of the bent portion 27*a*. Thus, as shown in an enlarged view of FIG. 4, a small space as an annular oil groove, or an annular oil passage 43 is provided by the stepped portion 11*c* and the valve plate assembly 13. That is, the annular oil groove 43 is surrounded by an inner peripheral surface 27*b* of the bent portion 27*a* of the gasket 27, an outer peripheral surface 28*c* of the suction valve forming plate 28 and the front surface of the valve plate 29. The annular oil groove 43 of this embodiment extends along the entire circumference of the compressor. Alternatively, an annular oil groove may be formed with a length corresponding to a half, two thirds or one third of the entire circumferential length by changing the shape of the outer peripheral surface of the suction valve forming plate 28.

An oil passage 42 is formed in the upper portion of the cylinder block 11. The oil passage 42 is communicates with the oil storage chamber 41 and also with the annular oil groove 43 by way of a hole 27*c* in the gasket 27, the hole 28*a* in the suction valve forming plate 28 and a notch 44 which is formed adjacently to the outer peripheral surface 28*c* of the suction valve forming plate 28. Referring to FIG. 1 and FIG. 2, the bolt hole 46 is located in the lower portion of the cylinder block 11. The bolt hole 46 communicates with the annular oil groove 43 by way of a hole (not shown) in the gasket 27, a hole 28*b* in the suction valve forming plate r) 28 and a notch 45 adjacently in the outer peripheral surface 28*c* of the suction valve forming plate 28.

Thus, a return passage for oil in the storage chamber 41 is constituted by the oil passage 42, the annular oil groove 43 and the bolt hole 46. Because the annular oil groove 43 has a narrowed space of a relatively long distance, the oil return passage has a throttle function. The oil G flows from the oil storage chamber 41 through the oil passage 42 to the annular oil groove 43, and flows further to the bolt hole 46 by way of either clockwise route 43*a* or counter-clockwise route 43*b* of the annular oil groove 43 as shown is FIG. 2, and then is discharged into the crank chamber 15 through the bolt hole 46. In the structure of FIG. 2, because the connection between the oil passage 42 and the annular oil groove 43 is located slightly rightward from the top as seen in FIG. 2, the oil G flows mainly through the clockwise route 43*a*. The connection between the oil passage 42 and the annular oil groove 43 may be located otherwise depending on the position of the oil storage chamber 41 and other structures.

The following will be described the operation of the compressor of the above structure. Because the annular oil groove 43 is formed to extend along the whole circumference of the compressor, the high-temperature and high-pressure oil G accumulated in the oil storage chamber 41 and flowing to the annular oil groove 43 through the oil passage 42 then flows by way of the clockwise route 43*a* and/or the counter-clockwise route 43*b* of the annular oil groove 43 to the bolt hole 46.

Because the annular oil groove 43 having a small cross-sectional area is relatively long, and is formed adjacent to the outer periphery of the compressor and hence close to the ambient air, the annular oil groove 43 functions as a throttle passage. Thus, the pressure of the oil G is reduced, and the oil G is efficiently cooled by passing through the annular oil groove 43. The oil G whose pressure and temperature have been reduced, passes through the gap between the bolt 48 and the bolt hole 46, and then returns to the crank chamber 15. Thus, the oil G is used for lubrication of the sliding parts of the compressor.

Because the annular oil groove 43 is a long passage, the annular oil groove 43 may be formed so as to have a relatively large cross-sectional area as compared to a shorter passage. In the case where a passage of either one of the clockwise route or counter-clockwise route is clogged with foreign matters, the oil G flows to the bolt hole 46 through the passage which is free of the clogging. In the case where the amount of the oil G in the oil storage chamber 41 is small or very small especially at startup of the compressor, the discharged refrigerant gas may pass through the oil storage chamber 41 and may enter directly into the oil return passage. However, the throttling function of the annular oil groove 43 prevents the refrigerant gas from entering into the oil return passage.

The following advantageous effects are obtained according to the compressor of the first preferred embodiment.

(1) The annular oil groove 43 is formed of a hermetically-closed space which is formed by the inner peripheral surface 27*b* of the bent portion 27*a* of the gasket 27 as a part of the stepped portion 11*c*, the outer peripheral surface 28*c* of the suction valve forming plate 28 and the valve plate 29. By the annular oil groove 43, the oil return passage having a throttle function can be made easily. Furthermore, any additional process for forming a narrow passage in the valve plate assembly 13 is not required and, therefore, the number of manufacturing processes for the compressor is reduced.

(2) Because the long annular oil groove 43 is made of a throttled passage, it may be formed to have a relatively large cross-sectional area as compared to a shorter passage. Such a passage with the large cross-sectional area is advantageous in that it is less susceptible to clogging with foreign matters contained in the oil G.

(3) Because the pressure of the high-pressure oil G is reduced by passing through the annular oil groove 43 functioning as a throttled passage with a narrow cross-sectional area, the oil G is flowed into the crank chamber 15 under a low pressure.

(4) Because the long annular oil groove 43 is formed adjacently to the outer peripheral portion of the compressor near ambient air, the high-pressure oil G can be efficiently cooled by passing through the annular oil groove 43.

(5) Because the annular oil groove 43 is formed extending along the whole circumference of the compressor, the oil G flows into the bolt hole 46 through the clockwise route 43*a* and/or the counter-clockwise route 43*b*. In case where the passage of either the clockwise route or counter-clockwise route is clogged with foreign matters, the oil G flows into the bolt hole 46 through the passage free of clogging, thereby improving the reliability in operation of the compressor.

(6) The annular oil groove 43 connects the storage chamber 41 to the crank chamber 15. The oil G which has been cooled and whose pressure has been reduced while passing through the annular oil groove 43 is returned to the crank chamber 15 through the bolt hole 46. Since the bolt hole 46 is used as an oil return passage, an additional work for providing an oil return passage may be eliminated.

(7) In the case when the amount of the oil G in the storage chamber 41 becomes small or very small, the discharged refrigerant gas may passes through the oil storage chamber 41 and may enter directly into the oil return passage, but the annular oil groove 43 having the throttling function prevents the refrigerant gas from flowing into the oil return passage.

Figure 5:
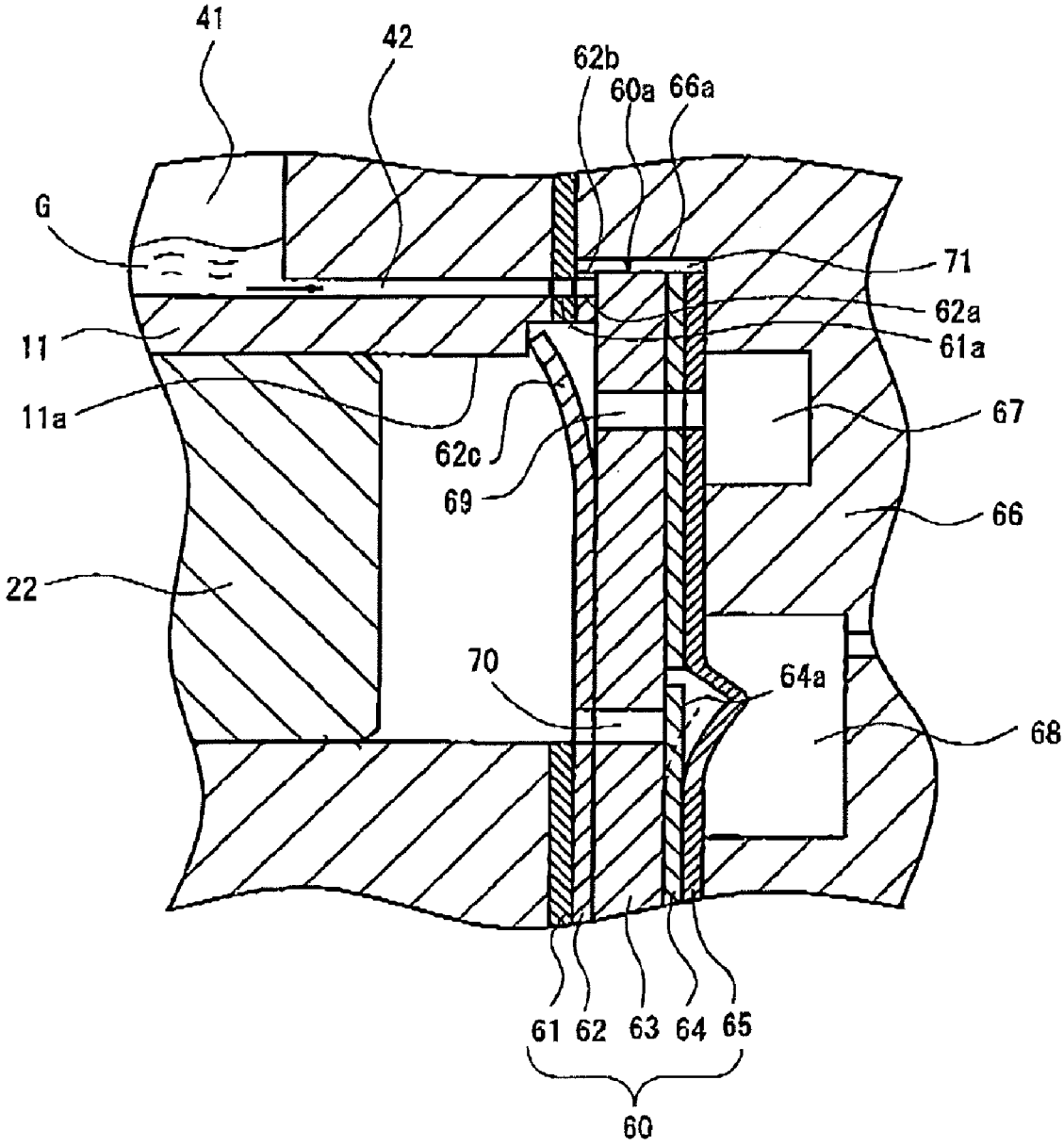
FIG. 5 is a partially enlarged cross-sectional view of a swash plate type variable displacement compressor according to a second preferred embodiment of the present invention.

The following will describe a compressor according to a second preferred embodiment of the present invention with reference to FIG. 5. The second preferred embodiment differs from the first preferred embodiment in that the structures of the recess 11*b*, the gasket 27 and the valve plate assembly 13 are modified. The other structures of this compressor are substantially the same as those of the first preferred embodiment. Common or similar parts or elements are designated by the same reference numerals as those of the first preferred embodiment and, therefore, the explanation thereof will be omitted and only the modifications will be described.

In the second preferred embodiment, a discharge chamber 68 is formed at a radially inner side of a rear housing 66 and a suction chamber 67 is formed at a radially outer side of the rear housing 66. The compressor has a valve plate assembly 60 which includes a gasket 61, a suction valve forming plate 62, a valve plate 63, a discharge valve forming plate 64 and a retainer plate 65, which are arranged in this order from the front of the compressor. In this embodiment, the gasket 61 is a part of the valve plate assembly 60. An annular recess 66*a* as a step, or stepped portion is formed in the rear housing 66. The suction valve forming plate 62, the valve plate 63, the discharge valve forming plate 64 and the retainer plate 65 are provided at the recess 66*a*, and the gasket 61 is interposed between cylinder block 11 and the rear housing 66.

Outer peripheral surfaces of the suction valve forming plate 62, the valve plate 63, the discharge valve forming plate 64, and the retainer plate 65 constitute outer peripheral surfaces 60*a* which face the inner peripheral surface of the recess 66*a*. Because the diameters of the outer peripheral surfaces are smaller than the diameter of the inner peripheral surface of the recess 66*a*, a hermetically-closed small or narrow space is formed by the dimensional differential. Accordingly, the narrow space as an annular oil groove, or an annular oil passage 71 is formed by the recess 66*a* as the stepped portion and the valve plate assembly 60. That is, the oil groove 71 is formed by the recess 66*a* of the rear housing 66, the outer peripheral surfaces 60*a* of the suction valve forming plate 62, the valve plate 63, the discharge valve forming plate 64 and the retainer plate 65 and the rear surface of the gasket 61. The valve plate 63 has plural suction ports 69 through which low-pressure refrigerant gas is drawn into each of the cylinder bores 11*a* from the suction chamber 67 and plural discharge ports 70 through which compressed high-pressure refrigerant gas is discharged from the cylinder bores 11*a* into the discharge chamber 68. The suction valve forming plate 62 has a suction valve 62*c* for opening and closing the suction port 69 and the discharge valve forming plate 64 has a discharge valve 64*a* for opening and closing the discharge port 70.

The oil passage 42 which communicates with the oil storage chamber 41 provided at the top of the cylinder block 11. The oil passage 42 is connected to the annular oil groove 71 by a hole 61*a* extending through the gasket 61, a hole 62*a* extending through the suction valve forming plate 62 and a notch 62*b* provided in the outer peripheral surface 60*a* of the suction valve forming plate 62. The bolt hole 46 located in the lower portion of the cylinder block 11 (referred to FIG. 1 and FIG. 2) is connected by a hole and a notch (not shown) which are formed in the gasket 61 and the suction valve forming plate 62. The operation of the compressor of the second preferred embodiment is substantially the same as that of the first preferred embodiment and, therefore, the explanation will be omitted.

According to the compressor of the second preferred embodiment, the following advantageous effect is obtained, as well as those effects which have been already mentioned in the paragraphs (2) through (7) for the first preferred embodiment.

(1) An oil return passage having the throttle function can be formed easily by the annular oil groove 71. The annular oil groove 71 which is formed as a hermetically-closed narrowed space formed by the recess 66*a*, the outer peripheral surfaces 60*a* of the suction valve forming plate 62, the valve plate 63, the discharge valve forming plate 64, the retainer plate 65, and the gasket 61. No special process is required for forming a narrowed oil return passage in the valve plate assembly 60, so that the number of the manufacturing processes for the compressor is reduced.

Figure 6:
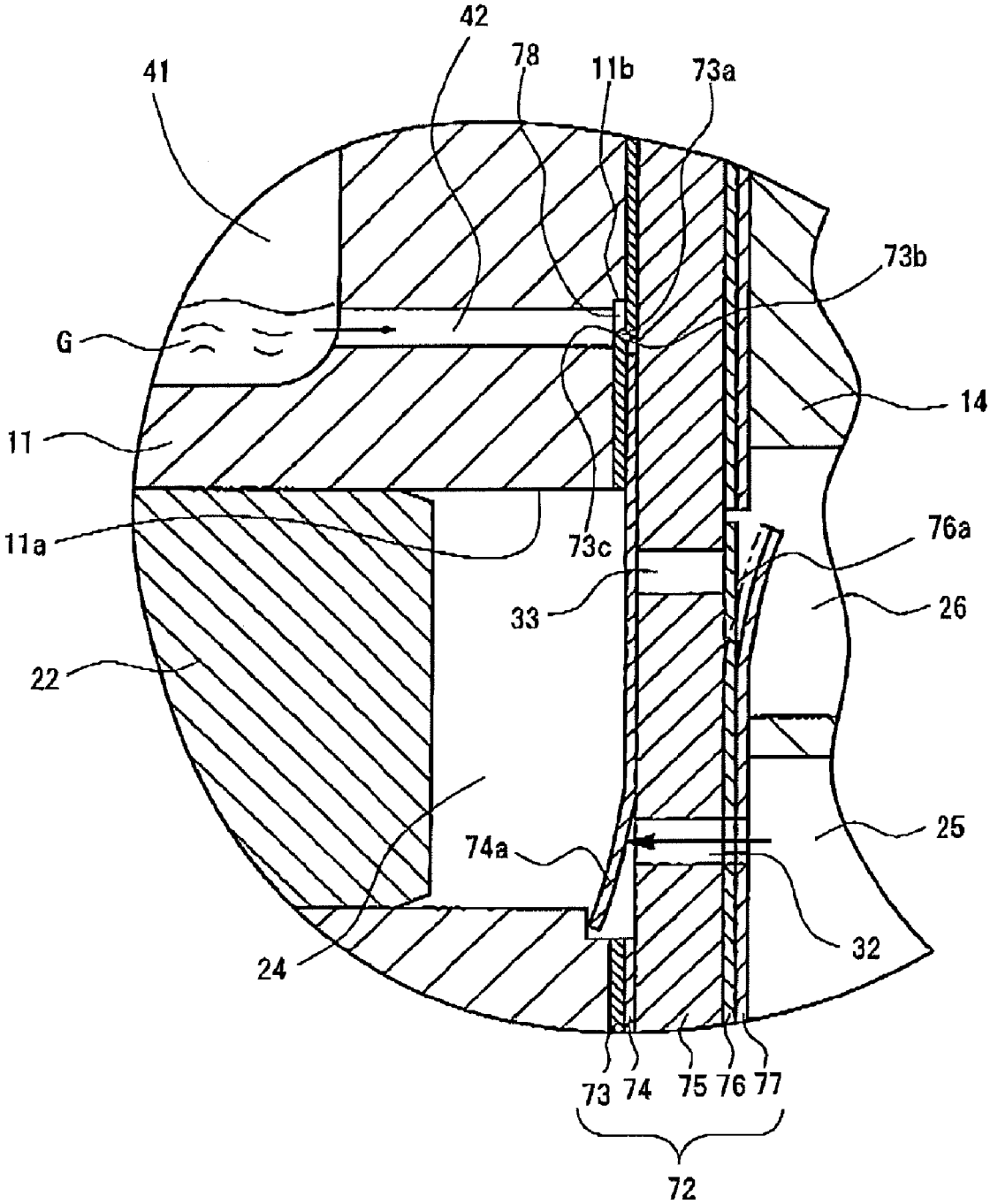
FIG. 6 is a partially enlarged cross-sectional view of a swash plate type variable displacement compressor according to a third preferred embodiment of the present invention.

The following will describe a compressor according to a third preferred embodiment of the present invention with reference to FIG. 6. The third preferred embodiment differs from the first preferred embodiment in that the structure of the recess is modified. The other structure of this compressor is substantially the same as that of the first preferred embodiment. Common or similar parts or elements are designated by the same reference numerals as those of the first preferred embodiment and, therefore, the description thereof will be omitted and the modifications will be described.

The annular recess 11*b* as a step, or a stepped portion is formed in the rear end surface of the cylinder block 11 in the form of a recess cut toward the front of the compressor in the axial direction of the drive shaft 16. The compressor has a valve plate assembly 72 which includes a gasket 73, a suction valve forming plate 74, a valve plate 75, a discharge valve forming plate 76 and a retainer plate 77 which are arranged in this order from the front of the compressor. The gasket 73 in this embodiment is a part of valve plate assembly 72. The gasket 73 has a bent portion 73*a* which is inserted into the space of the recess 11*b*. The diameter of the outer peripheral surface 73*c* of the bent portion 73*a* is slightly smaller than the diameter of the outer peripheral surface of the recess 11*b*. Accordingly an annular oil groove, or an annular oil passage 78 is formed as a hermetically-closed narrow space between the recess 11*b* and the outer peripheral surface 73*c* of the bent portion 73*a* of the gasket 73. A circular suction valve forming plate 74 is arranged on the side of the inner peripheral surface 73*b* of the bent portion 73*a* and pressed by the valve plate 75 to be in close contact with the gasket 73. The suction valve forming plate 74 has a suction valve 74*a* for opening and closing the suction port 32 and the discharge valve forming plate 76 has a discharge valve 76*a* for opening and closing the discharge port 33. The annular oil groove 78 of the third preferred embodiment extends along substantially the entire circumference of the compressor as in the first preferred embodiment. Alternatively, the annular oil groove 78 may be formed with a half, two thirds or one third of the entire circumference by modifying the shape of the outer peripheral surface of the suction valve forming plate 74.

The oil passage 42 communicates with the oil storage chamber 41 at the top of the cylinder block 11. The oil passage 42 is arranged to be directly connected to the annular oil groove 78. The annular oil groove 78 is a space provided at the recess 11*b* and connected directly to the bolt hole 46 (refer to FIG. 2) located in the lower part of the cylinder block 11. Thus, in the third embodiment, the notches 44, 45 in the first preferred embodiment are not required, thereby the structure of the annular oil groove 78 is simplified. The operation of the compressor of the preferred embodiment is substantially the same as that of the first preferred embodiment and, therefore, the explanation thereof will be omitted. Furthermore, the third preferred embodiment has the same advantageous effects as those of the first preferred embodiment in addition to the above-described simple structure of the annular oil groove 78.

Figure 7:
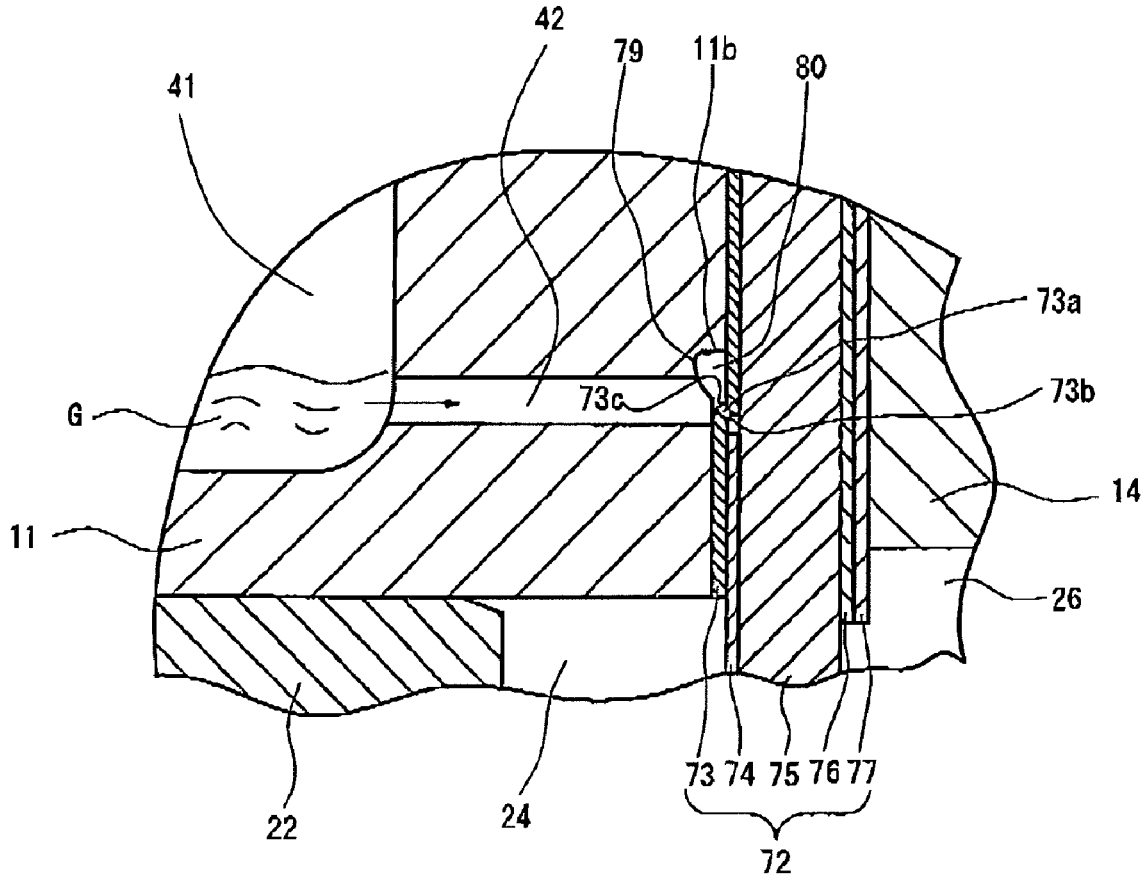
FIG. 7 is a partially enlarged cross-sectional view of a swash plate type variable displacement compressor according to a fourth preferred embodiment of the present invention.

The following will describe a compressor according to a fourth preferred embodiment of the present invention with reference to FIG. 7. The fourth preferred embodiment differs from the third preferred embodiment in that the structure of the recess 11*b* is slightly modified. Common or similar parts or elements are designated by the same reference numerals as those of the first and third preferred embodiments and, therefore, the explanation thereof will be omitted and only the modifications will be described.

The annular recess 11*b* as a step, or a stepped portion is provided in the rear end surface of the cylinder block 11 in the form of a recess cut toward the front of the compressor in longitudinal direction of the drive shaft 16. An enlarged recess 79 is formed in the outer periphery of the recess 11*b*. In addition, the structures of the recess 11*b*, the gasket 73 and the suction valve forming plate 74 are the same as the third preferred embodiment. The gasket 73 has the bent portion 73*a* and is in close contact with the cylinder block 11. The suction valve forming plate 74 is arranged on the side of the inner peripheral surface 73*b* of the bent portion 73*a* and pressed by the suction valve forming plate 74 to be in close contact with the gasket 27. Thus, an annular oil groove, or an annular oil passage 80 is formed by the recess 11*b* and the outer peripheral surface 73*c* of the bent portion 73*a* of the gasket 73. The space of the annular oil groove 80 of this embodiment is enlarged by the enlarged recess 79. The enlarged recess 79 is formed as an integral part of the recess 11*b* by molding, or the like and, therefore, no special process is required for forming the recess 79. In the present preferred embodiment, the annular oil groove 80 with the enlarged cross-sectional area serves to prevent the groove 80 from being clogged with any foreign matters contained in the oil G, and hence to stabilize the flow of oil G returning to the crank chamber 15. Other advantageous effects are the same as those of the first and second preferred embodiments and, therefore, the explanation thereof is will be omitted.

Figure 8:
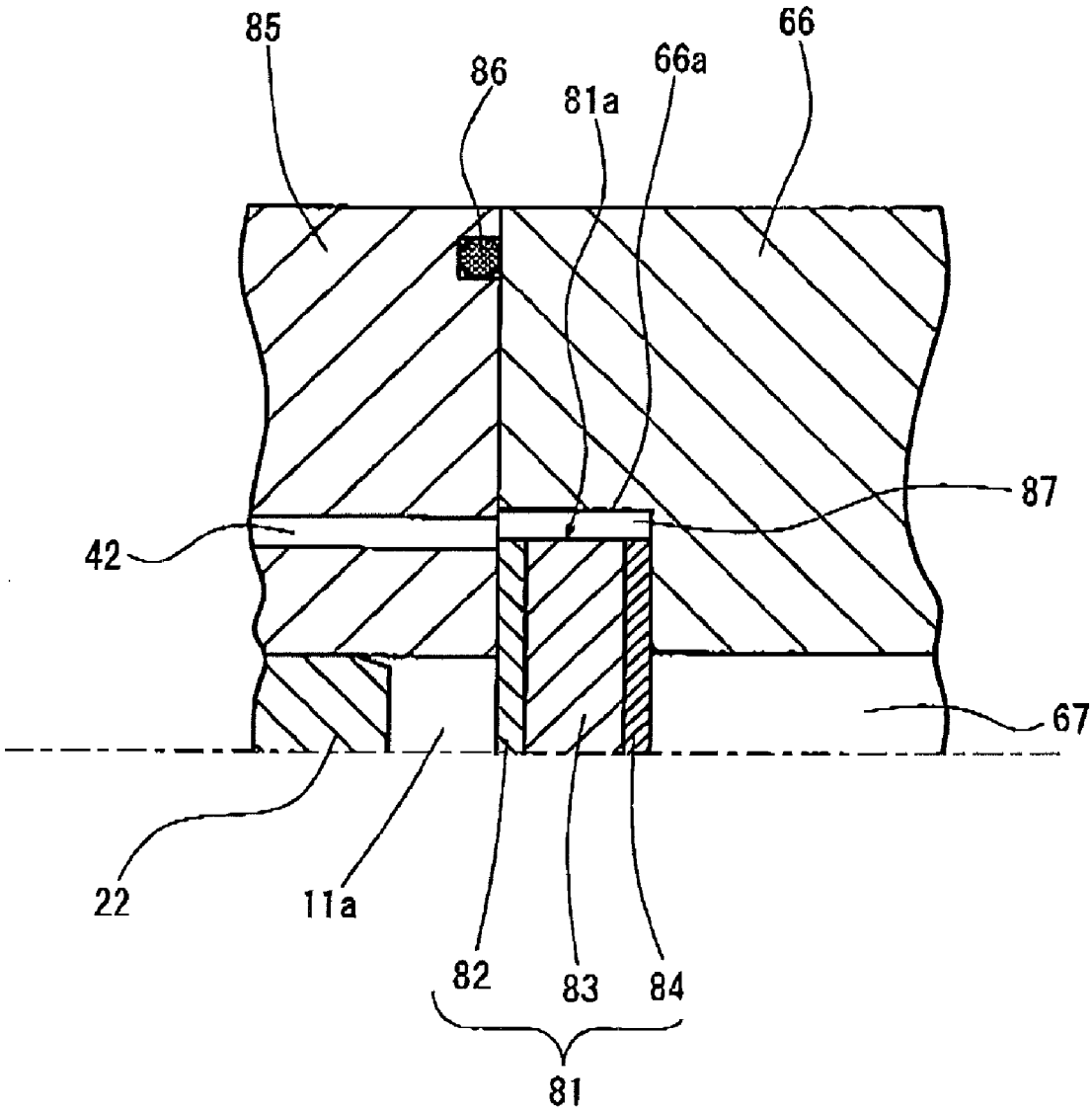
FIG. 8 is a partially enlarged cross-sectional view of a swash plate type variable displacement compressor according to the fifth preferred embodiment of the present invention.

The following will describe a compressor according to a fifth preferred embodiment of the present invention with reference to FIG. 8. The fifth preferred embodiment differs from the second preferred embodiment in that the structure of the recess 66*a* and the valve plate assembly 60 is modified and shows a case in which the present invention is applied to a double-headed piston type compressor. Common or similar parts or elements are designated by the same reference numerals as those of the second preferred embodiment and, therefore, the explanation thereof will be omitted and only the modifications will be described.

FIG. 8 shows a rear part of a double-headed piston type compressor wherein the present invention applied. The recess 66*a* as a step, or a stepped portion is formed in the rear housing 66 in the form of a recess cut rearward in axial direction of the drive shaft 16. A valve plate assembly 81 includes a suction valve forming plate 82, a valve plate 83 and a gasket 84 which are arranged in this order from the front of the compressor. The valve plate assembly 81 is arranged in the recess 66*a*. The diameter of the outer peripheral surfaces of the suction valve forming plate 82, the valve plate 83 and the gasket 84, or, the outer peripheral surface 81*a* of the valve plate assembly 81 is smaller than the diameter of the inner periphery of the recess 66*a*, and a narrow space is formed by such difference of diameters. The suction valve forming plate 82 made of metal is disposed in direct contact with a rear cylinder block 85 correspond to a cylinder block of the present invention made of metal, thereby producing a metal seal, and defining the cylinder bores 11*a* (only one cylinder bore being shown in the drawing). An o-ring 86 is provided between the rear cylinder block 85 and the rear housing 66 for sealing of the compressor. The gasket 84 is provided in close sealing contact with the end surface of the recess 66*a* and cooperates with the rear housing 66 to define the suction chamber 67.

Thus, a closed narrow space is formed as an annular oil groove, or an annular oil passage 87 which is formed by the recess 66*a* of the rear housing 66, the outer peripheral surface 81*a* of the valve plate assembly 81 and the rear surface of the rear cylinder block 85. The oil passage 42 communicating with the oil storage chamber 41 (refer to FIG. 5) at the top of the rear cylinder block 85 is formed to be directly connected to the annular oil groove 87. Similar to the second embodiment, the annular oil groove 87 is connected to the bolt hole 46 at the lower position of the cylinder block 85 (referring to FIG. 2). This preferred embodiment shows that the annular oil groove 87 is provided in the rear housing 66 of the double-headed piston type compressor. According to the present invention, however, an annular oil groove similar to the groove 87 of FIG. 8 may be provided in the front housing. The advantageous effects of the present preferred embodiment are the same as those of the first and second embodiments, and the explanation thereof will be omitted.

Figure 9:
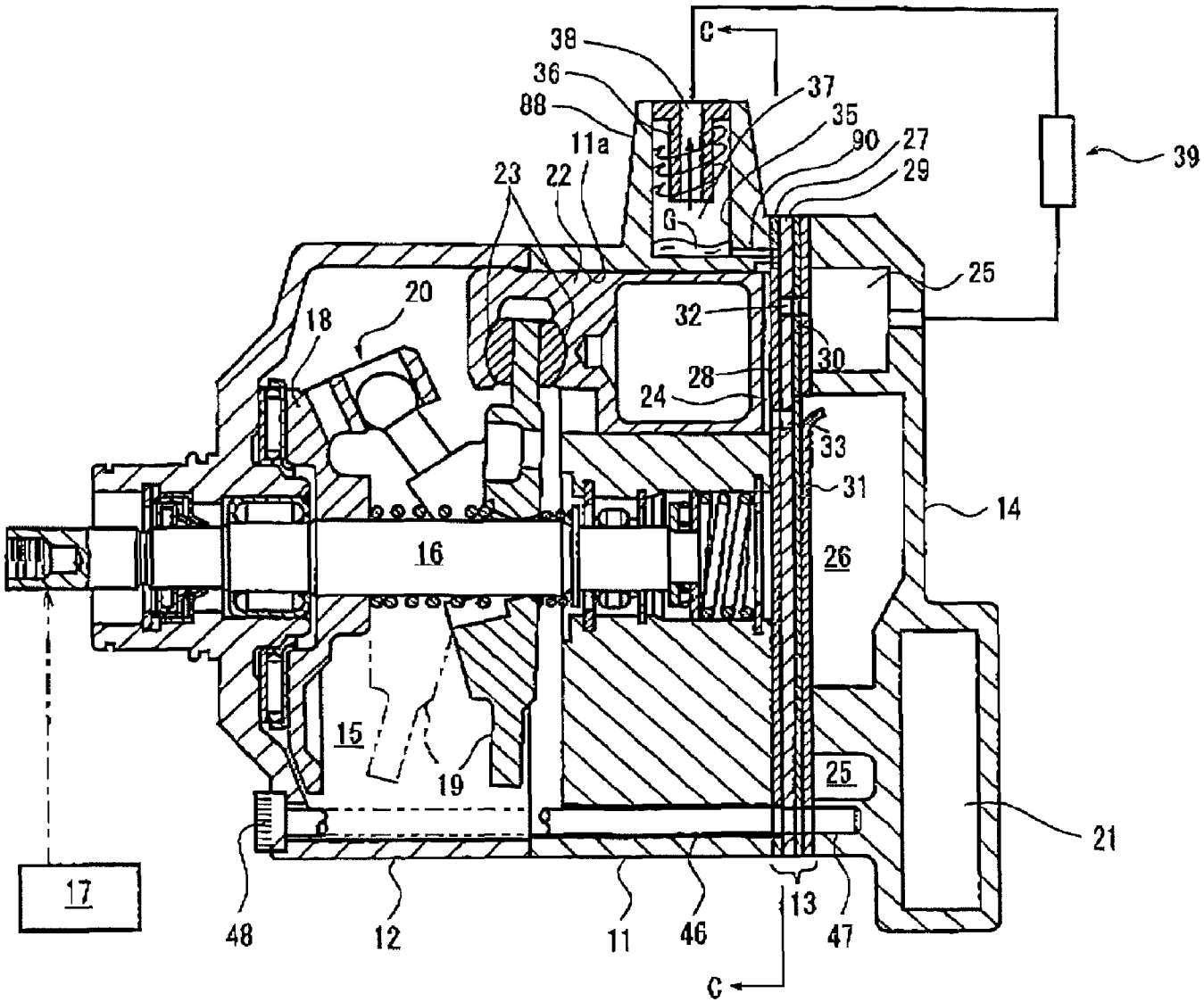
FIG. 9 is a longitudinal sectional view of a swash plate type variable displacement compressor according to a sixth preferred embodiment of the present invention.
Figure 10:
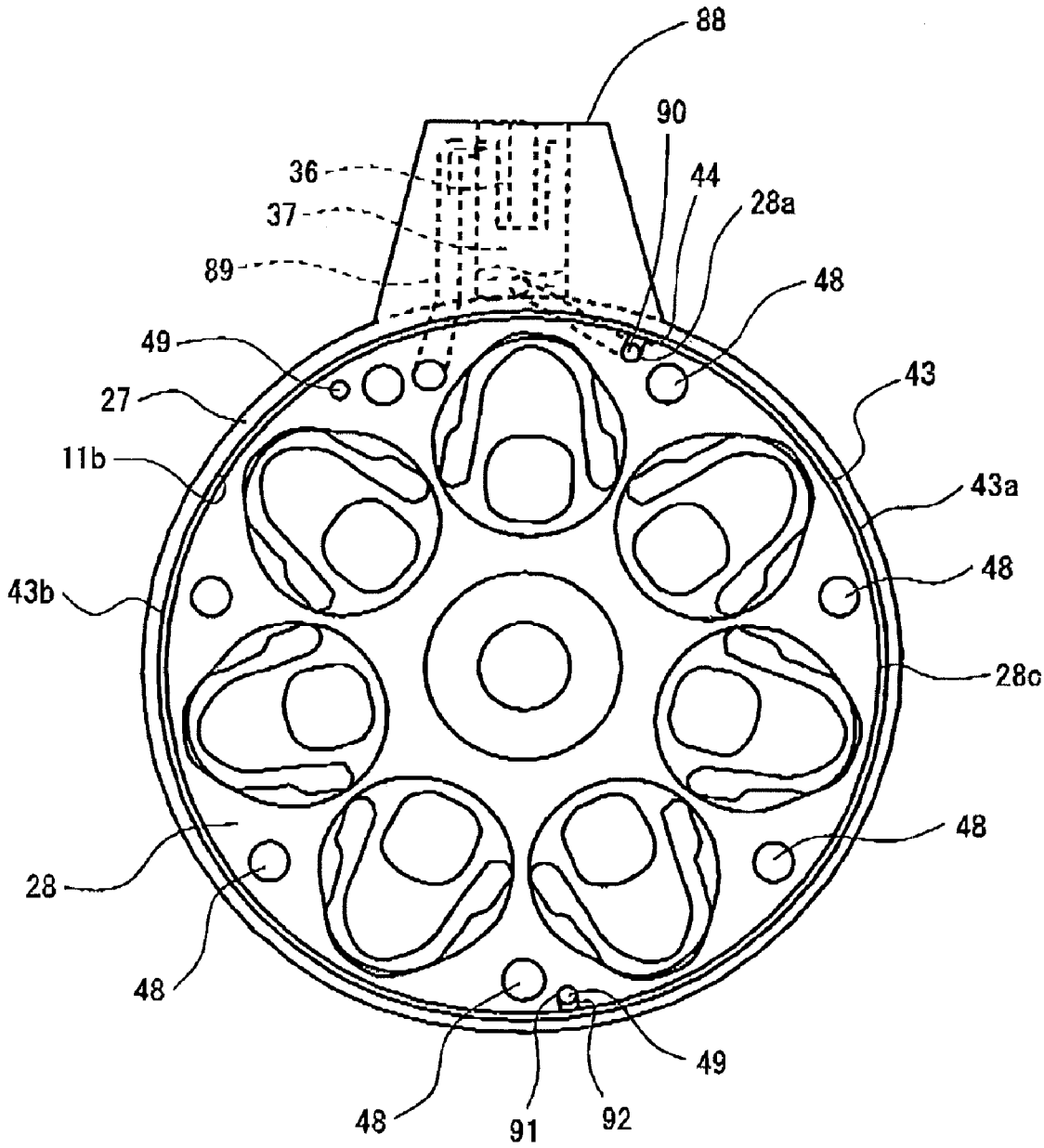
FIG. 10 is a cross-sectional view taken along the line C-C in FIG. 9.
Figure 11:
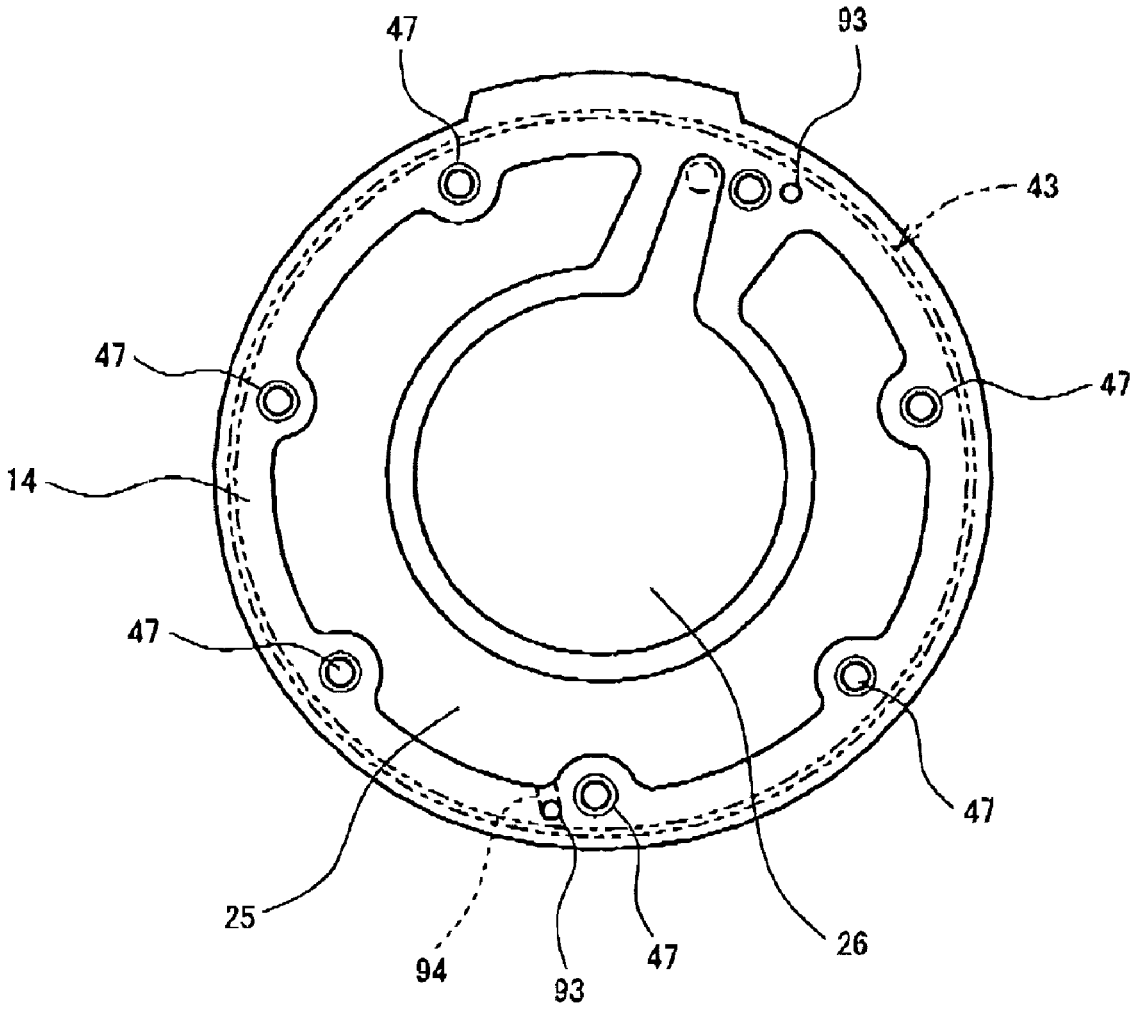
FIG. 11 is an elevation view showing a rear housing of the compressor according to the sixth preferred embodiment as viewed from the front thereof.

The following will describe a compressor according to a sixth preferred embodiment of the present invention with reference to FIG. 9 through FIG. 11. The sixth preferred embodiment differs from the first preferred embodiment in that the installation of the oil storage chamber 41 is modified and the annular oil groove 43 communicates with a positioning hole for locating positioning pin. Common or similar parts or elements are designated by the same reference numerals as those of the first preferred embodiment and, therefore, the explanation thereof will be omitted and only the modifications will be described.

In the present preferred embodiment, as shown in FIG. 9, the discharge chamber 26 is formed in a radially inner region of the rear housing 14 and the suction chamber 25 is formed in a radially outer region of the rear housing 14. The separation chamber 37 in which the oil separator 36 is installed is provided in a protrusion 88 at the top of the cylinder block 11. The separation chamber 37 is formed by press fitting the cylindrical oil separator 36 into an upstanding cylindrical hole 35 formed in the protrusion 88. As shown in FIG. 10, the separation chamber 37 communicates with the discharge chamber 26 through a discharge passage 89. Thus, the refrigerant gas is introduced into the separation chamber 37 from the discharge chamber 26 through the discharge passage 89.

The oil G centrifuged in the separation chamber 37 is accumulated in the separation chamber 37 at the bottom thereof. In this preferred embodiment, the separation chamber 37 thus functions as an oil storage chamber. An oil passage 90 is formed in the lower portion of the separation chamber 37 and communicates through the oil passage 90 with the annular oil groove 43 which is formed in the outer peripheral portion of the valve plate assembly 13. Thus, the oil G accumulated at the bottom of the separation chamber 37 flows into the annular oil groove 43 through the oil passage 90.

As shown in FIG. 10, the two positioning pins 49 projecting rearward are provided in the upper and lower portions of the cylinder block 11. The positioning holes 91 are formed in the suction valve forming plate 28 for receiving therein the corresponding positioning pin 49. The positioning holes 91 are formed extending through the valve plate assembly 13. The positioning holes 91 for the lower positioning pin 49 are connected to the annular oil groove 43 through a notch 92 formed in the outer peripheral surface 28*c* of the suction valve forming plate 28.

As shown in FIG. 11, two positioning holes 93 are formed in the rear housing 14 with a predetermined depth for receiving therein the corresponding positioning pin 49 which is fixed to the cylinder block 11. The lower positioning hole 93 communicates with the suction chamber 25 through a passage 94. When the positioning pin 49 on the cylinder block 11 is inserted into the positioning hole 93 of the rear housing 14 for connection thereto, the annular oil groove 43 is connected to the suction chamber 25 through the positioning hole 91, 93 and the passage 94.

In operation of the compressor, the oil G accumulated in the separation chamber 37 flows through the oil passage 90 to the annular oil groove 43 and further to the positioning hole 91, 93 through either of the clockwise route 43*a* or the counter-clockwise route 43*b* to flow to the suction chamber 25 through the passage 94. The operation of the compressor according to the sixth preferred embodiment is the substantially same as that of the first preferred embodiment, therefore, the explanation thereof will be omitted.

According to the compressor of the sixth preferred embodiment, the following advantageous effects are obtained. The advantageous effects as mentioned in the paragraphs (1) through (5) and (7) of the first preferred embodiment are common to the sixth preferred embodiment and, therefore, the advantageous effects other than the above will be described as follows.

(1) By providing the passage 94 for communication between the suction chamber 25 and the positioning hole 93, the positioning hole 93 can be used as an oil return passage for fluid communication between the annular oil groove 43 and the suction chamber 25. Thus, a manufacturing process for providing a new passage is not required.

(2) Since the separation chamber 37 functions as an oil storage chamber, a separated oil storage chamber is not required. Thus, the number of manufacturing processes and of parts for providing an oil storage chamber is reduced.

The present invention is not limited to the embodiments described above but may be modified into various alternative embodiments as exemplified below.

In the first through fifth preferred embodiments, the oil G in the oil storage chamber 41 flows into the crank chamber 15 by connecting the annular oil grooves 43, 71, 78, 80, 87 to the bolt hole 46. Alternatively, the oil G in the oil storage chamber 41 flows into the suction chamber 25, 67 by providing a separate passage for connecting the annular oil grooves 43, 71, 78, 80, 87 to the suction chambers 25, 65.

In the first through fifth preferred embodiments, the bolt hole 46 serves also as a passage for connecting the annular oil grooves 43, 71, 78, 80, 87 to the crank chamber 15. Alternatively, the positioning hole formed in the cylinder block 11 for positioning of the cylinder block 11 and the rear housing 14 may be used for communication instead of the bolt hole 46. The rear housing 14 may be positioned by inserting a positioning pin fixed to a rear housing 14 into the positioning hole in the cylinder block 11 so as to communicate with the crank chamber 15. Thus, the existing hole may be used as an oil return passage and, therefore, manufacturing process for providing a separated oil return passage is not required.

In the second preferred embodiment, the annular oil groove 71 is formed by a space defined by the recess 66*a* of the rear housing 14, the outer peripheral surfaces 60*a* of the suction valve forming plate 62, the valve plate 63, the discharge valve forming plate 64 and the retainer plate 65 and the gasket 61 forms the annular oil groove 71. Alternatively, a narrow space may be formed as an oil groove by the recess 66*a* of the rear housing 14, the outer peripheral surface of the suction valve forming plate 62 and the valve plate 63. Alternatively, a narrow space may be formed as an oil groove by recess 66*a* of the rear housing 14, the outer peripheral surfaces of the suction valve forming plate 62 and the valve plate 63 and the discharge valve forming plate 64. Similarly, in the fifth preferred embodiment, an oil groove may be formed by the suction valve forming plate 82 or both of the suction valve forming plate 82 and the valve plate 83.

In the first and second preferred embodiments, the notch 45 for connecting the annular oil groove 43, 71 to the bolt hole 46 is provided in the suction valve forming plate 28, 62. Alternatively, the bolt hole 46 may be formed at a position where the bolt hole 46 communicates directly to the annular oil groove 43, 71 without an intervening passage such as the notch 45.

In the first through fifth preferred embodiments, the oil storage chamber 41 is provided at the top of the cylinder block 11 at the front side of the separation chamber 37 and at the higher position than the separation chamber 37. Alternatively, the oil storage chamber may be provided at any suitable position, such as on either lateral side of the separation chamber 37 or under the separation chamber 37.

In the above-described preferred embodiments, the present invention has been described as applied to a single-headed piston type variable displacement swash plate compressor. As is obvious to those skilled in the art, the present invention is applicable to various other types of compressor such as double-headed piston type, fixed displacement or wobble plate type compressor.

Therefore, the present examples and embodiments are to be considered as illustrative and not restrictive, and the invention is not to be limited to the details given herein but may be modified within the scope of the appended claims.

What is claimed is:

1. A refrigerant gas compressor comprising:

a cylinder block with two ends formed with a plurality of cylinder bores;

a front housing disposed at one of the two ends of the cylinder block;

a rear housing disposed at the other end of the cylinder block;

a drive shaft supported by the cylinder block and one of the front housing and the rear housing;

a crank chamber formed in one of the front housing and the rear housing;

a swash plate rotatably disposed in the crank chamber, the swash plate being driven by the drive shaft;

a suction chamber and a discharge chamber formed in one of the front housing and the rear housing;

a valve plate assembly disposed between the cylinder block and at least one of the front housing and the rear housing, a storage chamber that is separate from the crank chamber for storing therein oil separated from refrigerant gas;

an oil passage connected to the storage chamber for the oil to flow from the storage chamber;

a stepped portion at least partially formed in a gasket that receives part of the valve plate assembly; and an annular oil groove formed by the stepped portion and the valve plate assembly and connected to the oil passage for connecting the storage chamber with one of the crank chamber and the suction chamber, wherein at least a portion of the oil groove is radially offset from the oil passage.

2. The compressor according to claim 1, wherein the gasket is disposed between the cylinder block and the valve plate assembly, wherein the stepped portion is formed as a bent portion of the gasket adjacent to a recess in the cylinder block.

3. The compressor according to claim 2, wherein the valve plate assembly includes a suction valve forming plate and a valve plate, wherein the oil groove is formed by an outer peripheral surface of the suction valve forming plate, an inner peripheral surface of the bent portion of the gasket and the front surface of the valve plate.

4. The compressor according to claim 1, wherein the oil groove extends annularly along an entire circumference of one of the cylinder block, the first housing and the second housing.

5. The compressor according to claim 1, wherein the oil groove is formed adjacently to an outer peripheral portion of the compressor.

6. The compressor according to claim 1, wherein the cylinder block has a bolt hole for receiving therein a bolt, the bolt hole communicates with the crank chamber.

* * * * *